US007080519B1

(12) United States Patent
Johnson, Sr.

(10) Patent No.: US 7,080,519 B1
(45) Date of Patent: Jul. 25, 2006

(54) METHOD AND APPARATUS FOR COOLING AC CONDENSING COILS

(76) Inventor: Tommy A. Johnson, Sr., P.O. Box 627, Swartz, LA (US) 71281

( * ) Notice: Subject to any disclaimer, the term of this patent is extended or adjusted under 35 U.S.C. 154(b) by 354 days.

(21) Appl. No.: 10/663,105

(22) Filed: Sep. 16, 2003

Related U.S. Application Data

(63) Continuation-in-part of application No. 10/192,197, filed on Jul. 9, 2002, now Pat. No. 6,619,059.

(51) Int. Cl.
*F28D 3/00* (2006.01)
*F28D 5/00* (2006.01)

(52) U.S. Cl. ..... 62/171; 62/305

(58) Field of Classification Search ..... 62/158, 62/171, 231, 305
See application file for complete search history.

(56) References Cited

U.S. PATENT DOCUMENTS 3,635,046 A * 1/1972 Sato et al. ..... 62/305
6,619,059 B1 * 9/2003 Johnson, Sr. ..... 62/171

* cited by examiner

*Primary Examiner*—Melvin Jones
(74) *Attorney, Agent, or Firm*—Robert N. Montgomery

(57) ABSTRACT

A method and apparatus for cooling an air conditioning system's condensing coils utilizing an air filter pad made of glass fibers with self contained, perforated water capillary tubes allowing moisture to permeate the filter pad. The filter pads may be connectable in series and provided with integral mounting strips for fixed or magnetic, internal or external attachment to the condensing unit. Special adaptive solenoids are also provided to allow for minimum flow of water over long periods of time. Dual sensors are provided connected to both the high and low side of the compressor for sensing compressor temperature status and switching the solenoid on and off, thereby preventing freezing of the compressor. A unique method for applying chilled water to the capillary tubes by coiling the capillary tube around the suction line of the compressor is utilized. The system may be provided in kits with several pads adapted for use with a wide variety of condensing unit configurations including automotive and further includes valves, tubing, wiring and connection boxes, insulation components for enclosing compressor tubing and water pump and reservoir as required, along with detailed instructions for assembly and installation.

10 Claims, 8 Drawing Sheets

METHOD AND APPARATUS FOR COOLING AC CONDENSING COILS

This is a continuation-in-part of previous application Ser. No. 10/192,197 filed Jul. 9, 2002 now U.S. Pat. No. 6,619,059 currently waiting for issue. This invention relates generally to water vapor cooling systems for air-cooled condensing units and more particularly to improvements thereto.

FIELD OF THE INVENTION

GENERAL BACKGROUND

Conventional air conditioning systems used for many commercial and residential dwellings utilize an outside compressor unit housing the compressor motor and the condensing coils which are normally cooled by passing a forced draft stream of ambient air through the coils. It is generally known within the air conditioning art that an over all reduction in energy can be achieved in an air conditioning system by improving the efficiency of the condensing coils' ability to quickly dissipate heat. Therefore, numerous systems have been proposed that provide means for applying water vapor to the coils, thereby lowering the ambient temperature of the air stream being drawn over the coils and thus increasing the efficiency of the system.

Each of the prior art systems recognizes the need to cool the ambient air passing over the condensing coils. The prior art also seems to agree that the most effective and economical way to achieve this is by providing a water fog or spray system, located in front of the coils, activated by a solenoid valve and a preset temperature sensor. The prior arts all disagree on the precise method of how the spray system should be configured to achieve the most effective result. Since the air conditioning manufacturers have not yet incorporated such system into OEM systems, the technology has been left in the hands of the after market. It is therefore of prime concern that such water spray cooling systems be provided to the after market in a manner so that the air conditioner owner or AC maintenance personnel can easily install and maintain such a system. Secondly the system must also be as efficient as possible.

Problems associated with such systems in the prior art range from too much water, thereby causing debris buildup, mold and mildew, and oxidation in the units, solenoid failure and freeze ups as a result of abrupt temperature changes, to inefficiency due to lack of attention to detail in the installation process. It has been found that simply providing extra insulation to the compressor lines and cooling the spray water vastly improves efficiency.

Further improvements to this art are indicated that will allow an installer to easily accommodate the wide variety of condensing unit designs without compromising the system's integrity.

SUMMARY OF THF INVENTION

A more efficient method for cooling an air conditioning system's condensing coils can be achieved by providing an air filter pad made of glass fibers with self contained, perforated water capillary tubes that allow moisture to permeate the filter pad. Pads are connectable in series and provided with integral mounting strips for fixed or magnetic internal or external attachment to the condensing unit. Special adaptive solenoids are also provided to allow for minimum flow of water over long periods of time. Rather than relying on a single ambient temperature sensor for water control, dual sensors are provided connected to the high and low side of the compressor for sensing compressor temperature status and switching the solenoid on and off, thereby preventing freezing. A unique method for applying chilled water to the capillary tubes by coiling the capillary tube around the suction line of the compressor is utilized. The system may be provided in kits with several pads adapted for use with a wide variety of condensing unit configurations and includes valves, tubing, wiring and connection boxes, insulation components for enclosing compressor and water tubing, and detailed instructions. The system is further shown to be suitable for use on automobiles.

BRIEF DESCRIPTION OF THF DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
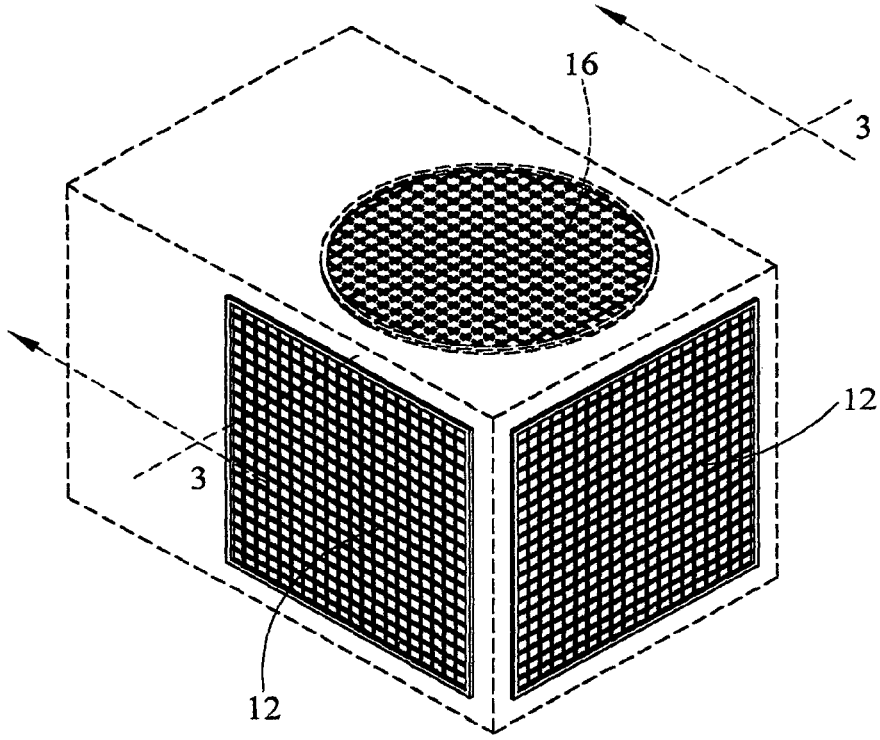
FIG. 1 is an isometric view of a typical air conditioning condensing unit.
Figure 2:
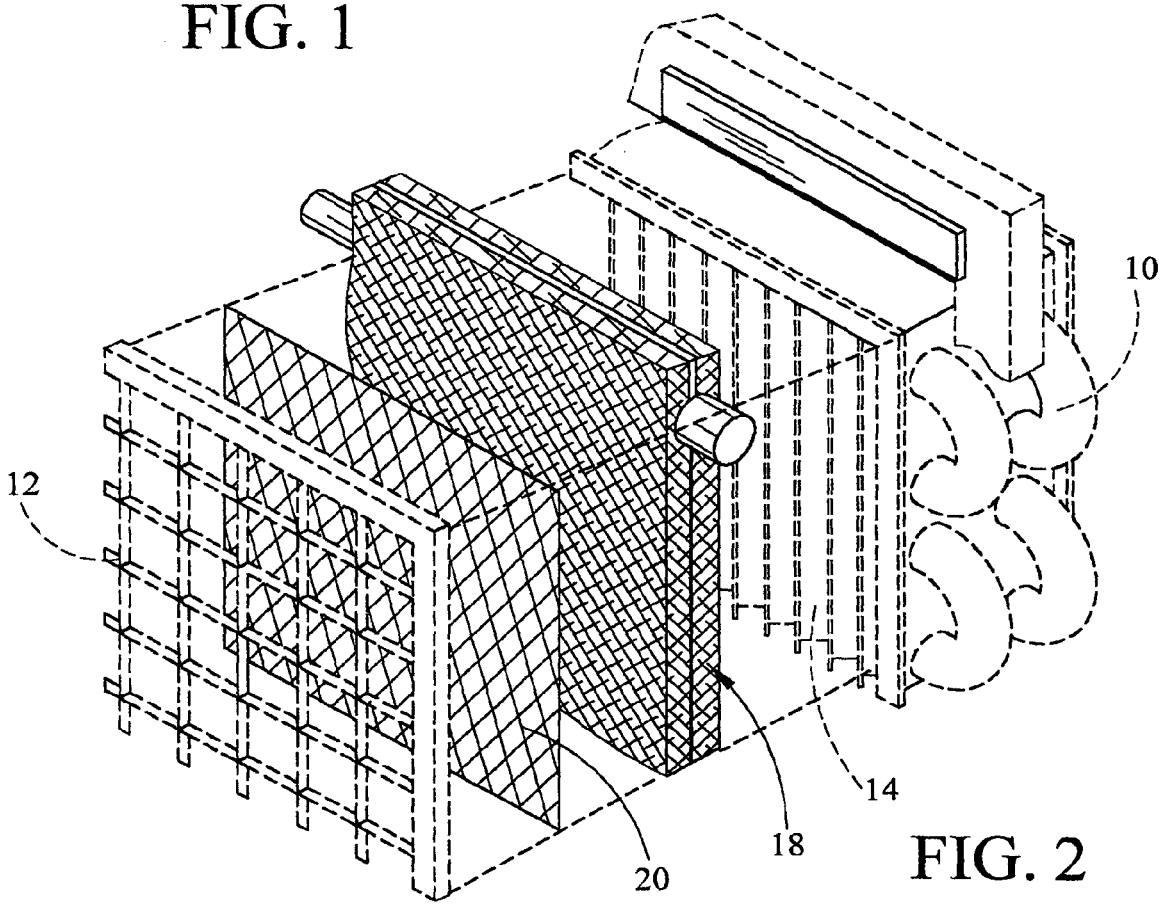
FIG. 2 is an exploded view of a typical condensing coil with a portion of the instant invention located between the condensing unit and the grill illustrated in FIG. 1.
Figure 3:
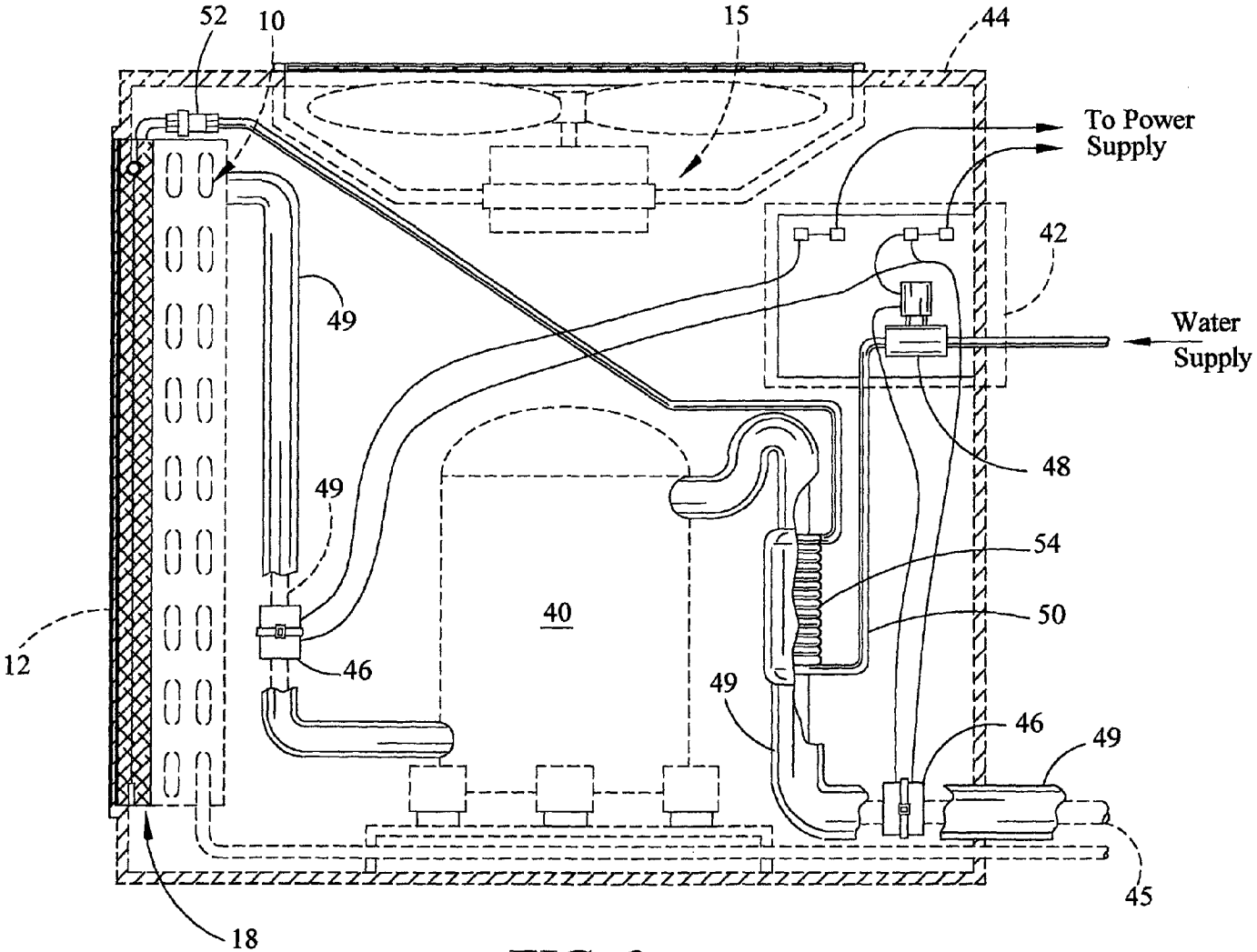
FIG. 3 is a cross section view of the condensing units taken along sight line 3—3 seen in FIG. 1.
Figure 7:
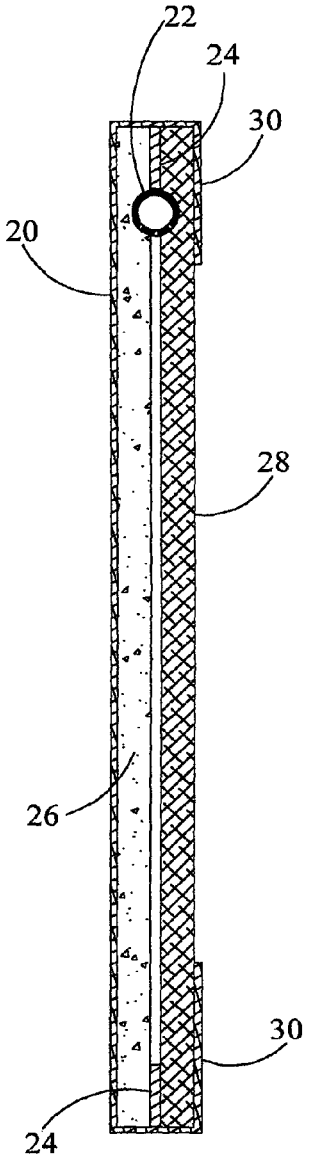
FIG. 7 is a cross section view of the filter element taken along sight line 7—7 seen in FIG. 6.
Figure 6:
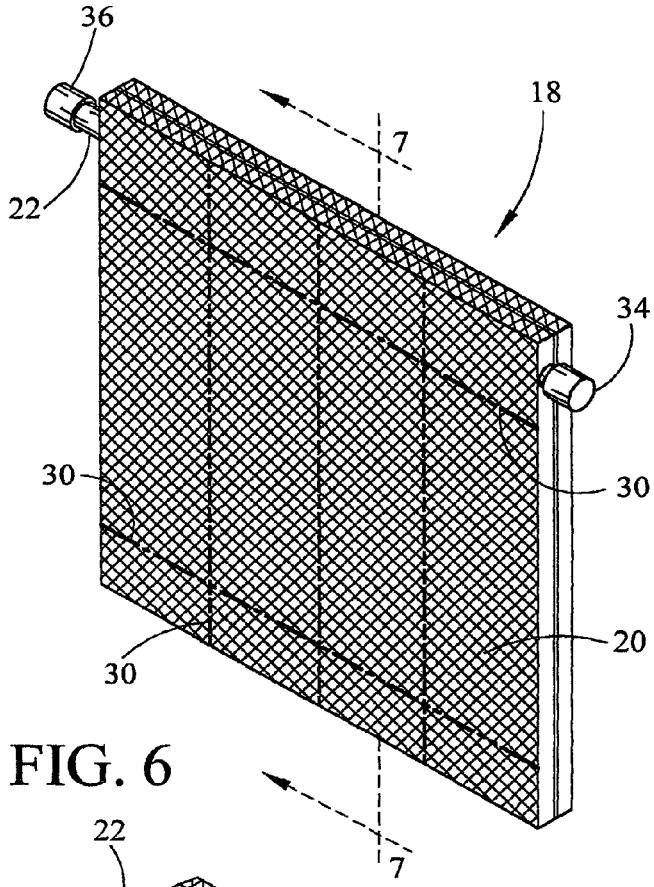
FIG. 6 is an isometric view of the filter element.
Figure 8:
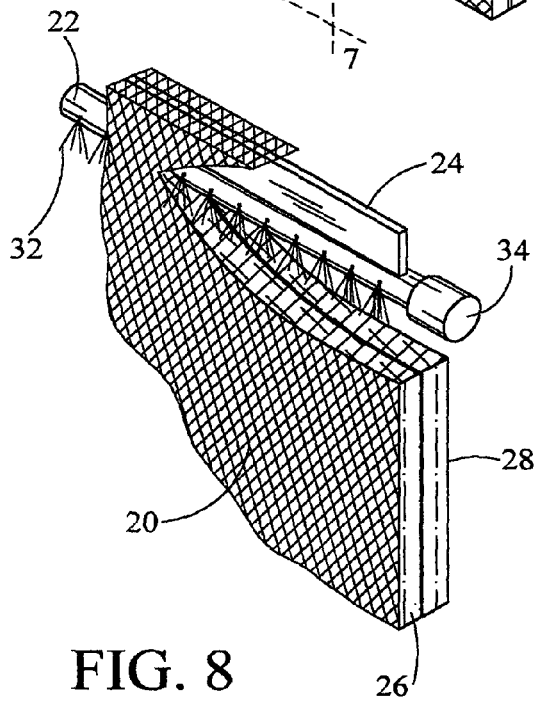
FIG. 8 is partial cross section of the filter element seen in FIG. 6 exposing the capillary tube and attachment bar.

Outdoor condensing units may take a wide variety of configurations, the most common of which is the rectangular shape seen in FIG. 1. The condensing coils 10 as seen in FIG. 2 are generally located behind one or more of the grill panels 12. The coils are generally surrounded by fins 14 that help dissipate heat from the tubes 10 as air is drawn across the coils and fins by a fan 15, seen FIG. 3, and expelled through the upper grill 16 seen in FIG. 1. The present invention utilizes a glass fiber filter pad panel 18 and includes a fine screen panel 20 located in front of the condensing coils 10 either inside or outside the grill panels 12 as seen in FIG. 2. The filter panels 18 and screen meshes 20 may be captured between the coils 10 and the grill 12 as seen in FIG. 3. A more detailed view of the filter panels 18 may be seen in FIG. 6 wherein it maybe seen that the panel 18 is constructed by utilizing a typical laminated fiberglass mat-type air conditioning return air filter having a about 1–5 micron particle rating. One of the laminated mats may be slightly denser than the other and thereby serves as the primary or outer filter side. Usually this is indicated by a white mat (exterior mat) and a blue mat lightly adhered together to form a single panel. As seen in cross section in FIG. 7, a capillary tube comprised of a length of ¼ inch vinyl tubing 22 is attached or otherwise adhered to a metal or magnetic strip 24 and inserted between the outer filter mat 26 and the inner mat 28. The filter mat is then wrapped by the fine mesh screen 20 and adhered thereto by several lines of epoxy 30. The screen 20 also may be sewn in a manner whereby a portion of the screen 30 overlapping the filter mat 28 forms a hem enclosing the strip 24 and tubing 22. Likewise, a hem is used to enclose a second metal, preferably stainless steel, or a magnetic strip 24 located at the lower edge of the panel 18. Passing the tubing 22 through a sewing machine utilizing a fairly large gauge needle, thereby penetrating both walls of the tubing, perforates the flexible vinyl tubing 22 in a manner whereby water 32 is only expelled when under pressure as seen in FIG. 8. The flexible vinyl tubing 22 located in each panel 18 may have a removable cap or a coupling fitting 36, seen in FIG. 6, for connection to adjoining panels and to the water supply system. The metal or magnetic strip 24 mentioned above may be utilized to attach the panel 18 to the enclosure of the condensing unit either internally or externally by fasteners or magnetic adhesion.

Looking now at FIG. 3 we see the filter panel 18 located in front of the coils 10 that are connected to the compressor 40. The water cooling system further includes the electrical control box 42, which may be mounted adjacent the electrical breaker box for the condensing unit or may be mounted as shown outside or inside the condensing unit housing 44. The control box 42 includes electrical power supply connections and connections for the temperature sensors 46, located in contact with the high and low side pressure lines leading to and from the compressor 40. It should be noted that the compressor lines are and should be fully insulated internally and externally to the condensing unit and insulation materials 49 should be provided in any water cooler kit for covering the pressure lines and the sensor elements 46. The control box 42 may include the water supply solenoid 48 or it may be mounted externally thereto. A polyethylene chill water line 50 leading from the solenoid valve 48 to its connection 52 with one or more filter panels 18 is coiled 54 around the low pressure or suction line leading to the compressor with sufficient contact and insulated to insure that the cold suction line pre-chills the water prior to entering the filter pads 18. It is important to note that the use of Polyethylene flexible tubing for the chill water line prevents tube collapse in warm weather.

An important aspect of providing a condensing unit water cooler system in kit form is the ease and ability to conform the system to the configuration of the condensing unit, prevent the intrusion of debris into the unit without excessive air flow restriction, and the ability to clean and maintain the system.

Figure 9:
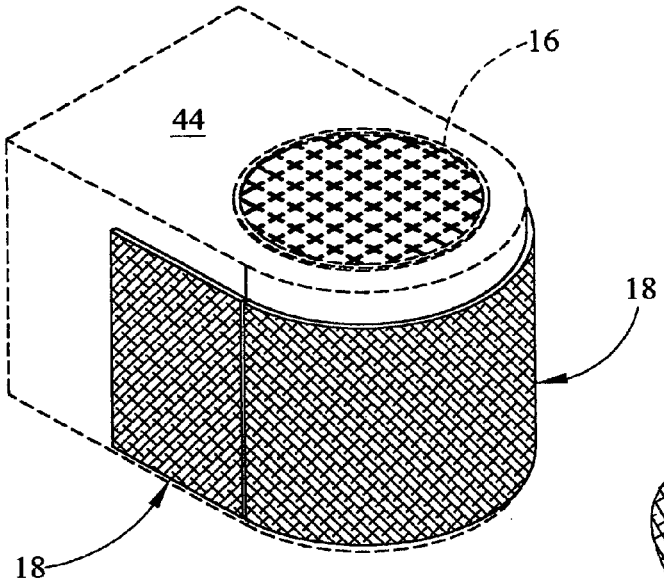
FIG. 9 is an isometric view of an alternate embodiment of semicircular condensing unit with externally adapted filter pads.
Figure 11:
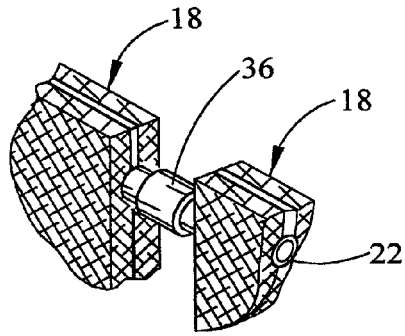
FIG. 11 is a partial isometric view of the connecting coupling for connecting the filter pads seen in FIG. 10.
Figure 10:
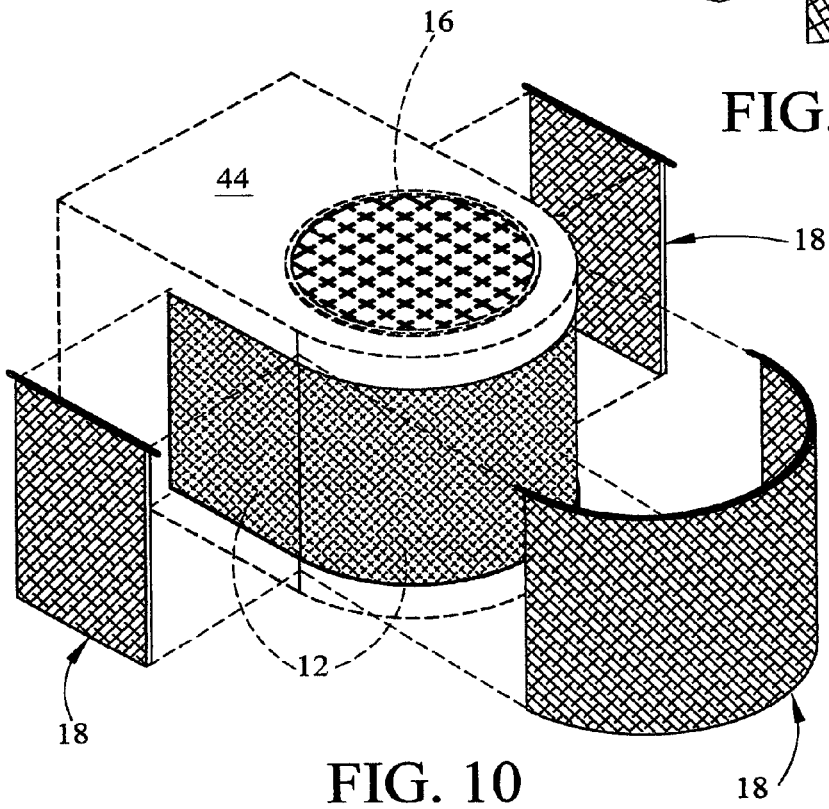
FIG. 10 is an exploded view of the condensing unit seen in FIG. 9.

As seen in FIG. 9, the filter pads 18 are flexible and thus readily contoured to almost any shape condensing unit and may be mounted externally, as seen in FIG. 10, by adherence of the metal or magnetic strips 24 directly over the grills 12, with multiple panels coupled as seen in FIG. 11 by coupling 36 of the perforated vinyl tubing 32.

Figure 4:
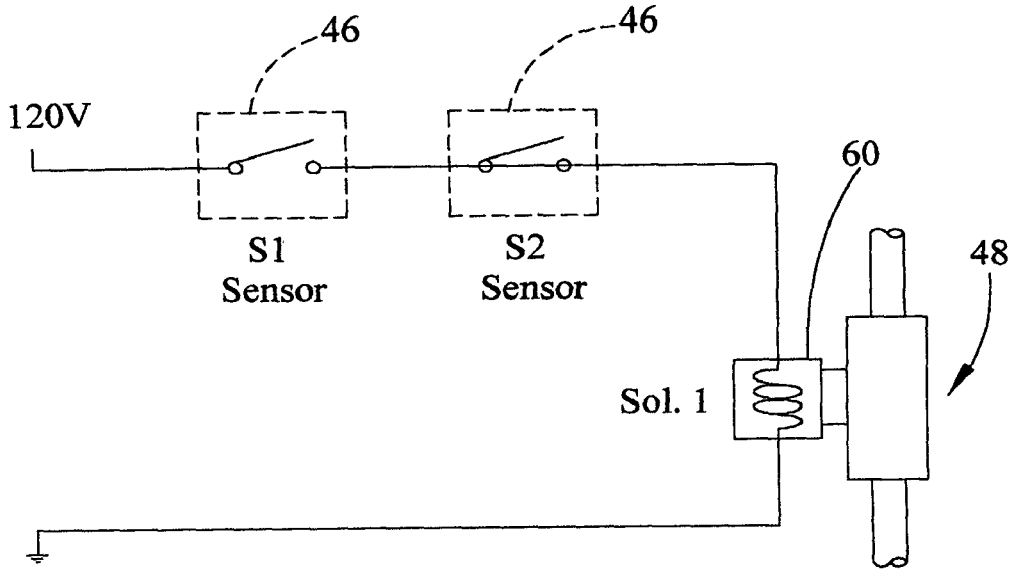
FIG. 4 is a wiring schematic.
Figure 5:
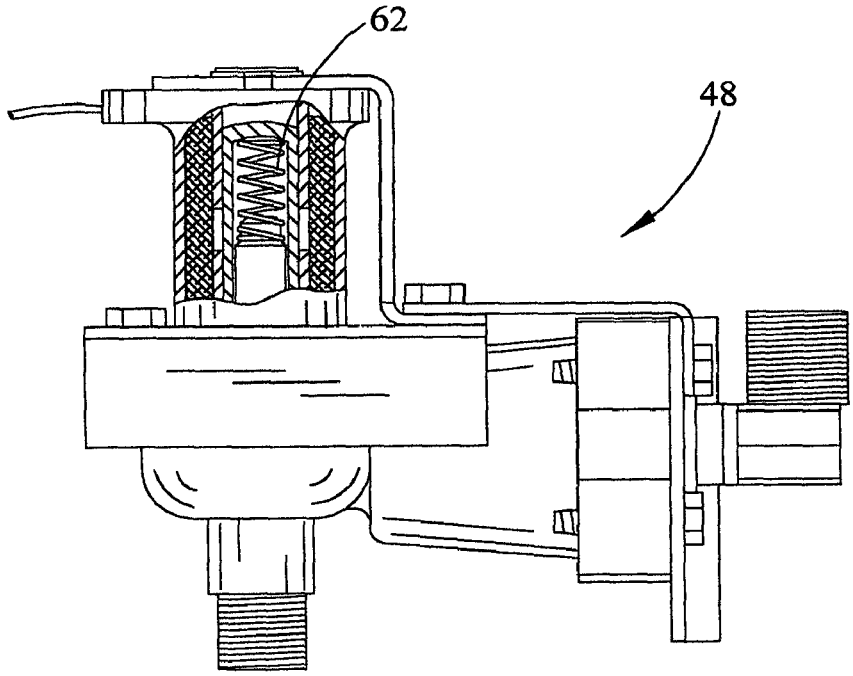
FIG. 5 is a partial cross section view of the solenoid valve exposing the valve spring.

Looking now at FIG. 4 we see that the sensors S1 and S2 located on the suction and high-pressure lines of the compressor are in series with the solenoid coil 60 of the electrically controlled water valve 48, therefore insuring that the required temperature differential must be present for operation of the solenoid 60. Since this solenoid valve may be required to remain open for long periods of time over several hours, solenoid must be rated for heavy-duty service. However, the valve spring 62 shown in FIG. 5 must allow the valve to remain partially open or partially closed at any given time. Springs normally provided with these type valves are designed to allow only normally open or normally closed operation. The preferred valve must be adapted for low voltage, preferably 24 volts, and pass only 8 to 40 ounces of water per minute at 30 to 45 PSI with a spring 62 adapted to be operated with only 0.380 Newtons or 0.0856 pounds of force.

In operation the temperature sensors 46 designated S1 and S2 and whereas S1 located on the high pressure line 43 between the compressor 40 and the condensing coil 10 is preset to make contact at 110 degree F. and open at 90 degrees F. Whereas the S2 sensor 46, located on the suction line 45, is preset to make contact at 50 degrees and open at 40 degrees. Since both sensors S1 and S2 are in series, there always must be a temperature differential of between 40 and 70 degrees with optimum compressor temperature being 50–55 degrees. By monitoring the compressor pressure and suction line temperature, the system automatically prevents freezing that often occurs with cool mornings or evenings combined with hot days.

As water is forced out of the perforations in the capillary tubes 32 at such a low rate of less than 40 ounces per min, in a weeping manner the water tends to follow the strands of fiberglass in the filter pad forming a cool moist curtain rather than simply saturating the coils with water, thereby optimizing water flow. The solor or fine mesh screen further provides a barrier to prevent debris from becoming trapped in the air filter and allows for easy wash down by hose to remove any accumulation of such debris.

[12]Water cooled condensing unit systems installed in the manner disclosed herein have been found to use 25 to 30 percent less power than the same previously non-cooled condensing unit.

Figure 12:
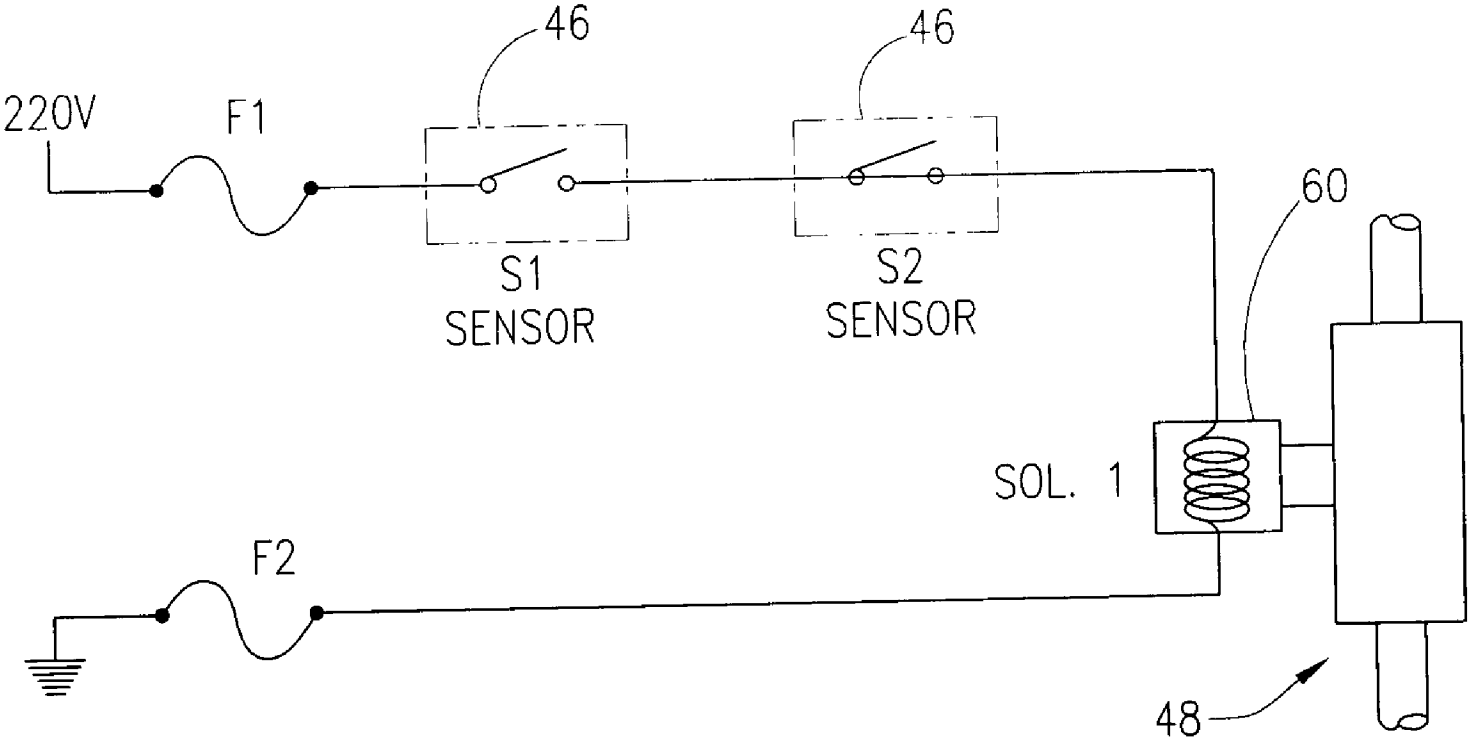
FIG. 12 is a second embodiment of the wiring schematic shown in FIG. 4.

It should be noted that the electrical schematic shown in FIG. 4 might include current limiting means such as isolation fuses F1,F2 not exceeding 3 amps each located on each side of the electrical load as shown in FIG. 12. this insures that the circuit is totally isolated from the AC control circuitry should a problem develop thereby not affecting the AC system's normal operation.

Figure 13:
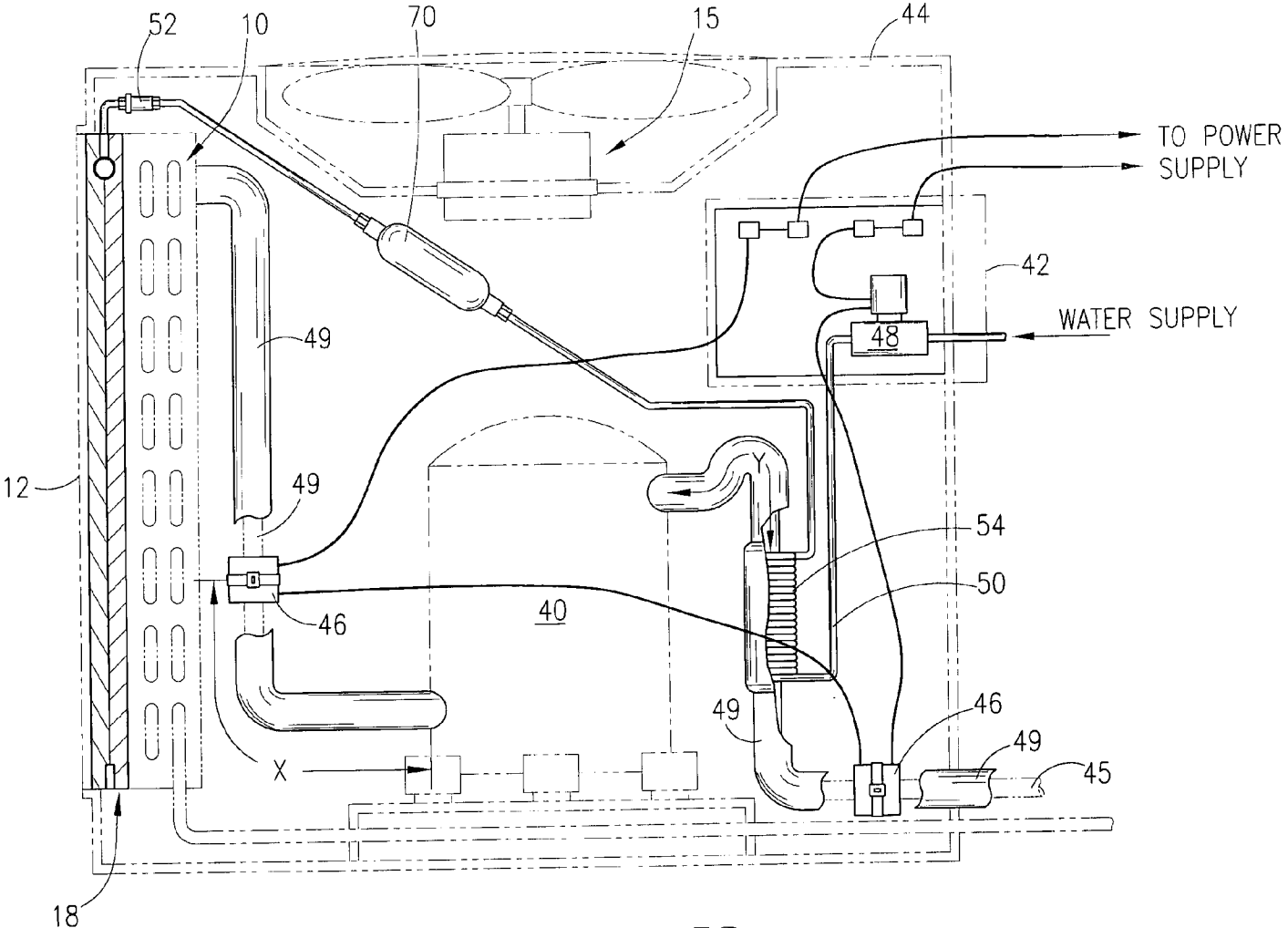
FIG. 13 is a second embodiment of the cross section view shown in FIG. 3 of the condensing units taken along sight line 3—3 seen in FIG. 1.

In addition the water supply in a great many areas have high calcium and other minerals or chemicals that tend to build up along the water supply lines and especially at the perforations along vinyl tube 22 thereby forming obstructions. Therefore in some cases it may be beneficial to install a water filter 70 inline with water supply line 50 between the coiled tubing 54 and the connection 52 as shown in FIG. 13.

Figure 14:
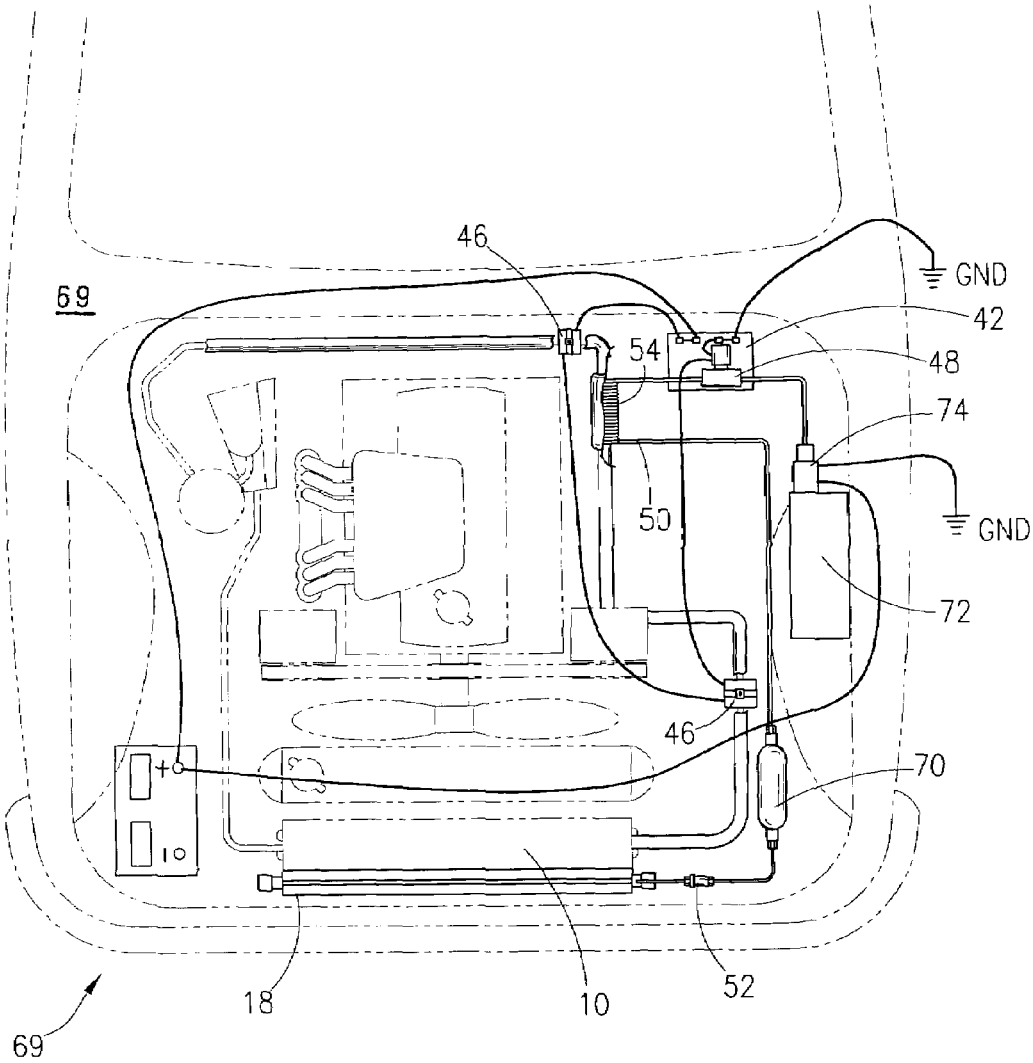
FIG. 14 is a top view of the AC cooling system as typically installed on an automobile.

It should also be understood that configuring the condensing cool cooling system to an automobile 69 is fully anticipated as indicated by FIG. 14. The system is anticipated as being generally the same as that used on stationary AC systems with the exception that a separate electrically controlled pressurized water supply may be provided or alternatively the system may be connected to the automobile's windshield pressure washer system.

As shown in FIG. 14 the filter pad 18 is located in front of the automobile's AC condensing coil 10 and plumbed through tubing line 50 to a water supply reservoir 72. The supply line 50 may also include the inline water filter 70 previously discussed. The electrical circuit is then installed using the automobiles battery power with sensors 46 located on both the high and low pressure compressor lines. The reservoir 72 may be self-charging thus maintaining a constant pressure to the solenoid valve 48 having its inlet port connected to the water supply pump 74 and its outlet port connected to the water tubing lines 50 or connected so that the pump 74 is activated when the solenoid is energized. Either method is achievable by those versed in the art.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A condenser coil cooling system for central air conditioners having externally located condensing and compressor units in a housing having a forced draft fan for drawing an air stream across the condensing coils comprising:

a) an air filter panel having fine screen meshes covering one face located within said air stream leading to said condensing coils;

b) a first length of flexible polymeric tubing having a plurality of perforations attached periodically to a rigid strip inserted along one edge of said filter panel;

c) a second length of flexible polymeric tubing having one end connected to said first length of polymeric tubing, a portion of which is coiled around and in contact with refrigeration suction tubing associated with said compressor;

d) an electrically controlled water valve having an inlet port connected to a source of pressurized water and an outlet port connected to said second length of flexible polymeric tubing;

e) a means for electrically controlling said water valve between open and closed positions in response to preset electrical temperature sensors located in contact with both said pressure and said suction refrigeration lines connected to said compressor; and f) a current limiting means not exceeding 3 amps located within an electrical circuit on each side of the electrical load involving said means for electrically controlling said water valve and said electrical temperature sensors.

2. The condenser coil cooling system according to claim 1 wherein said system further comprises a water filter connected to said source of pressurized water.

3. The condenser coil cooling system according to claim 2 wherein said water filter is connected between said first and second length of flexible polymeric tubing.

4. A condenser coil cooling system for air conditioners having condensing and compressor units with forced draft fans for drawing an air stream across the condensing coils comprising:

a) an air filter panel having fine screen meshes covering one face located within said air stream leading to said condensing coils;

b) a first length of flexible polymeric tubing having a plurality of perforations attached periodically to a rigid strip inserted along an upper edge of said filter panel;

c) a second length of flexible polymeric tubing having one end connected to said first length of polymeric tubing, a portion of which is coiled around and in contact with refrigeration suction tubing associated with said compressor;

d) an electrically controlled water valve having an inlet port connected to a source of pressurized water and an outlet port connected to said second length of flexible polymeric tubing;

e) a means for electrically controlling said water valve between open and closed positions in response to preset electrical temperature sensors located in contact with both said pressure and said suction refrigeration lines connected to said compressor; and f) a water filter connected to said source of pressurized water.

5. The condenser coil cooling system according to claim 4 wherein said source of pressurized water is a reservoir having a pump connected thereto.

6. The condenser coil cooling system according to claim 5 wherein said cooling system is installed on an automobile.

7. The condenser coil cooling system according to claim 6 wherein said cooling system further comprises a water supply reservoir.

8. The condenser coil cooling system according to claim 6 wherein said cooling system further comprises a pump means.

9. The condenser coil cooling system according to claim 6 wherein said cooling system is connected to a automobile's windshield washer system.

10. The condenser coil cooling system according to claim 6 wherein said cooling system is battery powered.

* * * * *